United States Patent [19]

Mixon, Jr.

[11] Patent Number: 4,752,237

[45] Date of Patent: Jun. 21, 1988

[54] SOLDERLESS CONNECTOR

[75] Inventor: James L. Mixon, Jr., Harrisburg, Pa.

[73] Assignee: AMP Incorporated, Harrisburg, Pa.

[21] Appl. No.: 78,363

[22] Filed: Jul. 27, 1987

[51] Int. Cl.[4] ..... H01R 4/24

[52] U.S. Cl. ..... 439/393

[58] Field of Search ..... 439/391, 393, 421, 430

[56] References Cited

U.S. PATENT DOCUMENTS 3,012,219 12/1961 Levin et al. .
3,288,914 11/1966 Fuller et al. .
3,836,944 9/1974 Lawson .
3,932,018 1/1976 Parsons et al. .
4,019,801 4/1977 Hoffman .
4,114,975 9/1978 Weidler .
4,445,874 5/1984 Evans .
4,522,460 6/1985 Beck, Jr. et al. ..... 439/393
4,673,232 6/1987 Tasaki ..... 439/393

*Primary Examiner*—Joseph H. McGlynn
*Attorney, Agent, or Firm*—Allan B. Osborne

[57] ABSTRACT

A solderless connector for terminating insulated wire. More particularly, the connector includes a wire receiving groove and pivotally mounted stripping arm which moves along the wire, stripping the insulation therefrom and electrically engaging the underlying conductor. A latch member restrains the stripping arm from regressive movement after stripping the wire.

14 Claims, 3 Drawing Sheets

SOLDERLESS CONNECTOR

FIELD OF THE INVENTION

The invention disclosed herein relates to insulation displacement type connectors wherein the termination is made by forcing the insulated wire into a slotted member whereupon the edges defining the slot cut through the insulation and make contact with the conductor.

BACKGROUND OF THE INVENTION

As shown in U.S. Pat. Nos. 3,012,219 and 3,836,944, insulation displacement type connectors include a slotted member positioned in a dielectric housing and a pusher for pushing the wire into the slot.

Generally, the pusher includes a dielectric member; e.g. the cover of the housing such as shown in U.S. Pat. No. 3,836,944, and a pair of pliers. Further, the known solderless connectors function by the wire being pushed into the slot with the edges thereof cutting through the insulation and engaging the conductor.

It is now proposed to provide a solderless connector of a much simpler design and which functions in a different manner.

SUMMARY OF THE INVENTION

According to the invention, a solderless connector is provided which includes a wire receiving groove for supporting an insulated wire and a stripping arm which is moved along the wire, stripping the insulation and electrically engaging the wire conductor. The wire receiving groove and stripping arm is stamped and formed from a coplanar strip of conductive material.

BRIEF DESCRIPTION OF THE DRAWINGS

FIG. 5 illustrates the connector mounted on a printed circuit board, panel or the like.

DESCRIPTION OF THE INVENTION

Figure 1:
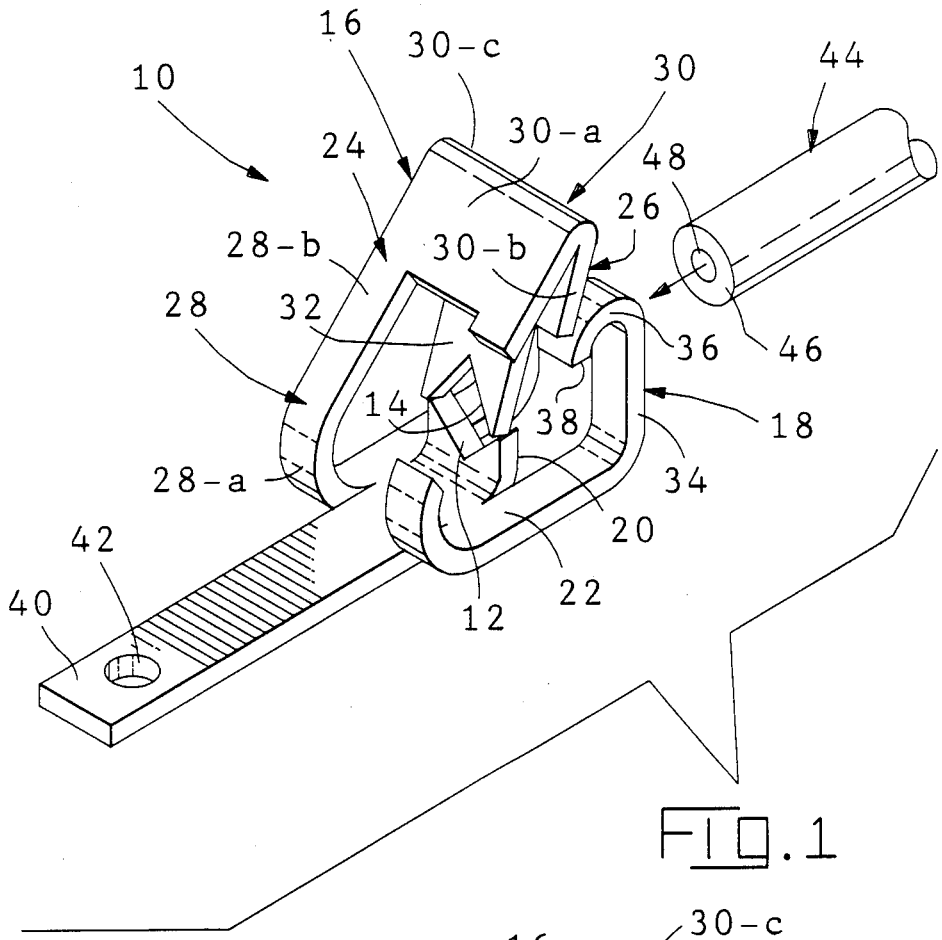
FIG. 1 is a perspective view of the solderless connector of the present invention.

With reference to FIG. 1, solderless connector 10 of the present invention is stamped and formed from flat stock of brass or copper alloy. Other materials can be used provided they have characteristics capable of performing stripping functions, electrical contact functions and have resiliency for locking functions, such characteristics being discussed more fully below.

Connector 10 includes, as integral parts thereof, wire receiving groove 12, stripping groove 14, stripping arm 16 and latch member 18.

Figure 2:
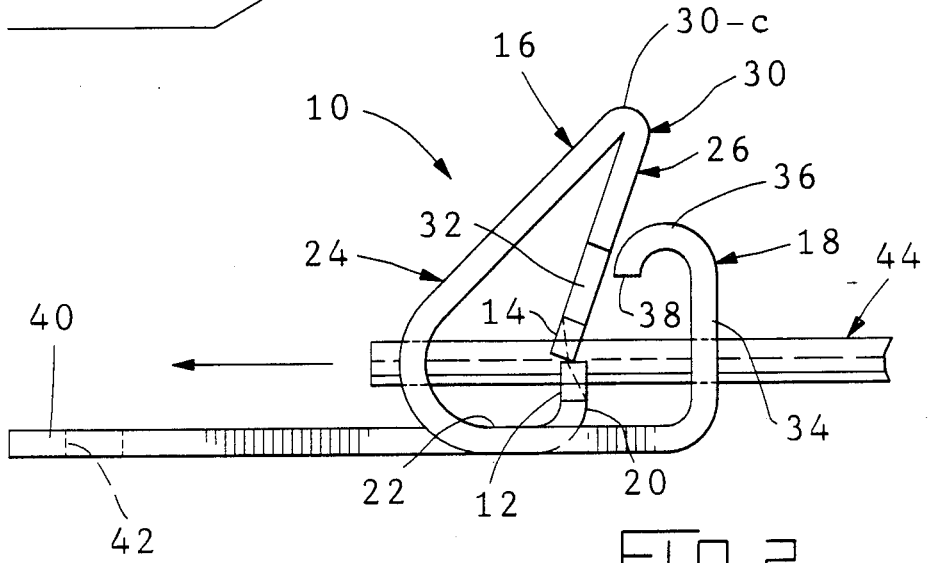
FIGS. 2 and 3 are side views of the connector illustrating the termination of an insulated wire.

Wire receiving groove 12 is located on the free end of tab 20 bent out of the plane of floor 22. Preferably, groove 12 is V-shaped although it could have an arcuate or other shape. Stripping groove 14 is located on the free end of stripping arm 16. It's shape is preferably a V also. As shown in FIGS. 1 and 2, groove 14 is positioned adjacent to and facing groove 12 and, as shown more clear in FIG. 2, is at an angle thereto.

Stripping arm 16 includes first and second sections 24, 26 respectively with the two sections being folded in towards each other. First section 24 includes two straps 28 attached to opposite sides of floor 22 and plate portion **30-*a* of plate 30. Each strap 28 includes curved portions 28-*a*, extending from floor 22 and straight portions 28-*b*. Curved portions 28-*a* describe an arc of about 135 degrees and straight portions 28-*b* connect to plate portion 30-*a*. Second section 26 includes portion 30-*b* of plate 30 and at the free end of portion 30-*b*, tab 32 which carries groove 14 at the free end thereof. Arm 16 is folded across plate 30 with the fold line indicated by reference numeral 30-*c*. First section 24 is formed to be at an angle of about forty five degrees relative to the plane of floor 22. Second section 26 is formed to be to one side of tab 20 and is at an angle of less than ninety degrees to first section 24. The angle at which second section 26 is to tab 20** is about twenty degrees.

Latch member 18 include two straps 34 which are attached to opposite sides of floor 22 and extend outwardly therefrom at an angle of about ninety degrees. Arcuate portions 36, located at the ends of each strap 34, curve around so that free end faces 38 thereon face floor 22.

End 40 of connector 10, located opposite locking member 18, includes hole 42 to permit the attachment of connector 10 to an electrical post (not shown). End 40 could have other configurations as desired; e.g. a forked or spade end.

Figure 3:
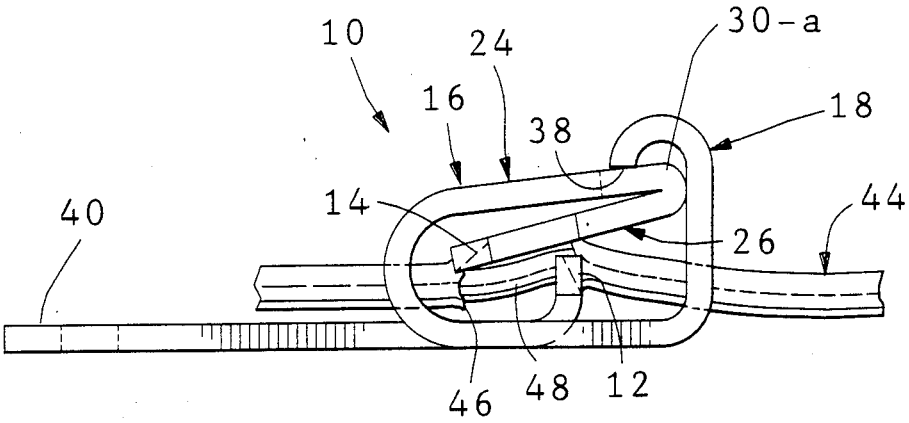

FIGS. 2 and 3 illustrate the termination of insulated wire 44 in connector 10. As shown in FIG. 2, insulated wire 44 is placed in between grooves 12,14. With wire 44 being inserted in the direction indicated by the arrow, the wire end should extend at least to straps 28. If wire 44 is inserted from end 40 of connector 10, it need only extend a short distance past groove 12. Thereafter, stripping arm 16 is forced towards floor 22 which pinches insulated wire 44 in between grooves 12,14. As arm 16 is forced further, bends towards first section 24, causing stripping groove 14 to slide along wire 44, stripping insulation 46 from and contacting conductor 48 thereof to establish electrical engagement therewith. Arm 16 is also pivoting about curved portions **28-*a* of straps 28**.

As stripping arm 16 is being pivoted towards floor 22, plate portion **30-*b* contacts arcuate members 36 and resiliently pivots latch member 18 away until fold line 30-*c* on plate 30 passes free end faces 38. Latch member 18 then moves back in with faces 38 sliding onto plate portion 30-*a* to latch stripping arm 16 in place as shown in FIG. 3. A suitable tool for bending arm 16** is a pair of pliers (not shown).

Figure 4:
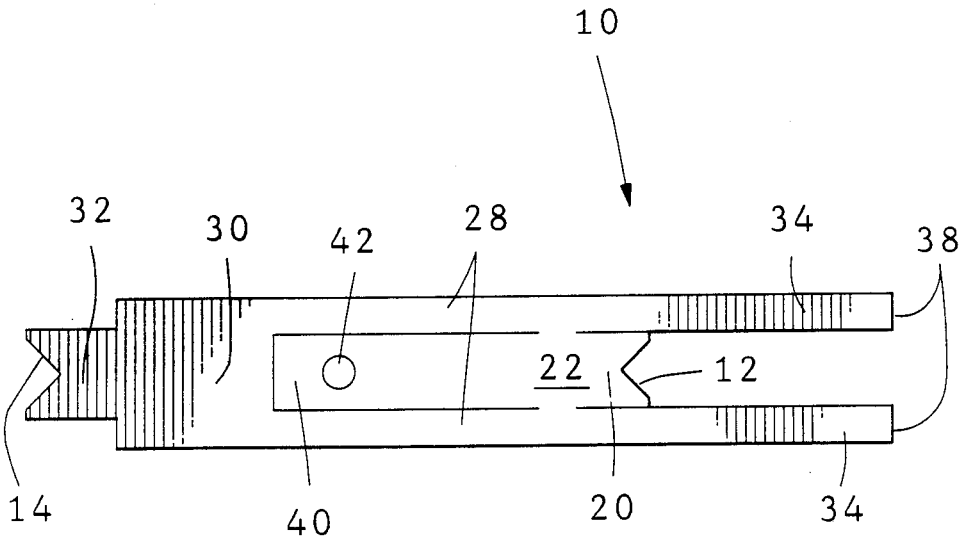
FIG. 4 is a plan view of a blank prior to being formed into a connector of the present invention.

A blank from which connector 10 is formed is shown in FIG. 4 with several parts described above being identified by the same reference numerals.

Figure 5:
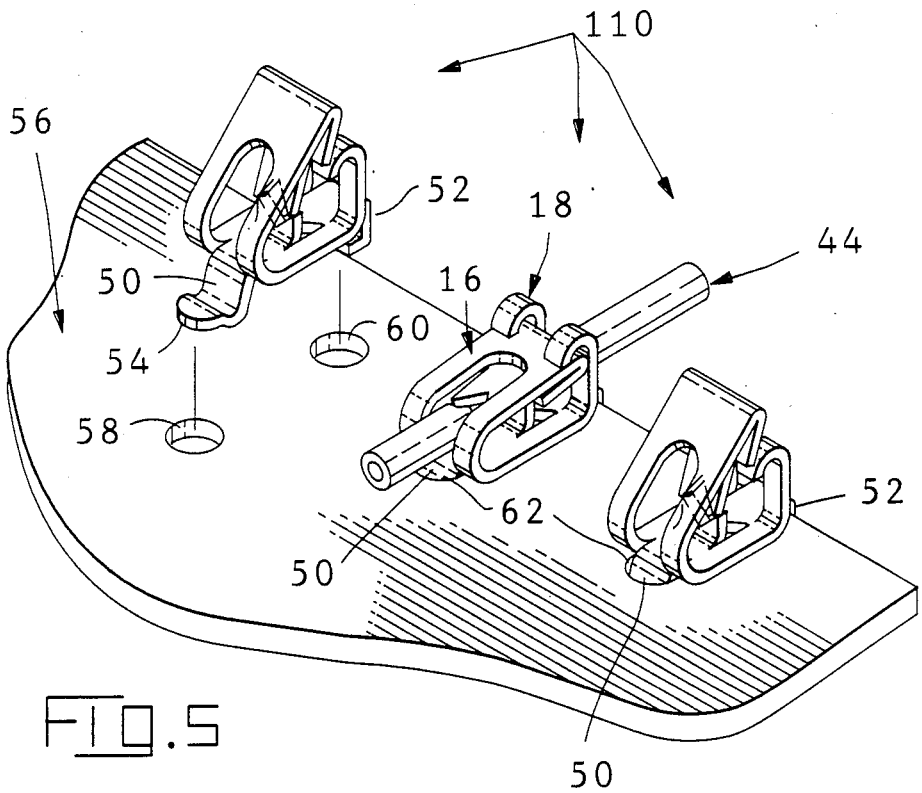

A variation of connector 10 is shown in FIG. 5 and is indicated by reference numeral 110. In this variation, a pair of mounting legs 50,52 are provided, one at each end of connector 110. Leg 50 slants away from floor 22 and includes a foot 54 at the free end. Leg 52 is L-shaped. Connector 110 can be mounted on panel 56 by inserting legs 50,52 in respective holes 58,60 or by putting leg 50 in one hole 62 and leg 52 around the edge of panel 56.

Figure 6:
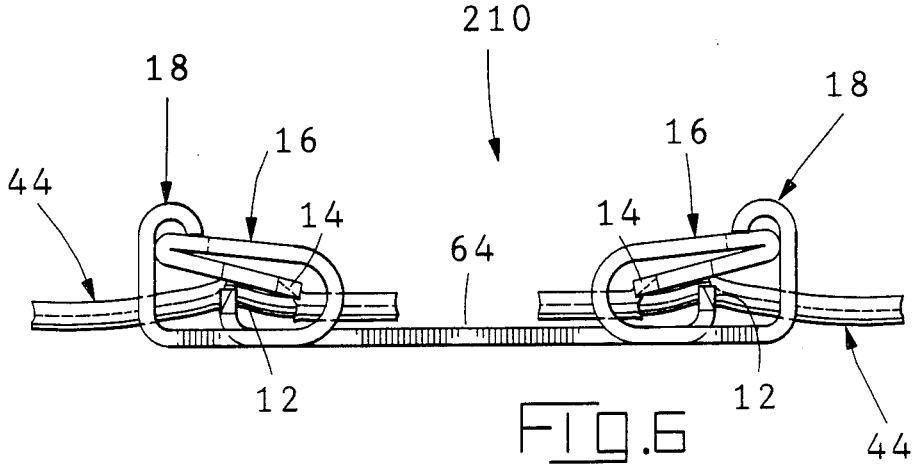
FIG. 6 is a side view of another embodiment of the connector of the present invention.

A further variation of connector 10 is shown in FIG. 6. Connector 210 consists of two connectors 10 attached to the respective ends of connecting strap 64. Connector 210 permits splicing a pair of wires 44 together.

As can be discerned, a solderless connector for terminating insulated wire has been disclosed. The connector includes a wire groove on a stationary tab and a stripping groove at the free end of a movable arm. As the arm is moved, the stripping groove slides along the wire, stripping the insulation and making electrical contact with the conductor.

I claim:

1. A solderless connector for terminating insulated wire, comprising;

wire receiving means for receiving an insulated wire; and stripping means for stripping insulation by being moved along an insulated wire positioned on said wire receiving means, said stripping means having stripping groove means for engaging the wire and pivotally mounted support means for supporting said stripping groove means.

2. The solderless connector of claim 1 further including floor means for supporting said wire receiving means and said stripping means.

3. The solderless connector of claim 2 wherein said support means of said stripping means include an arm folded into first and second sections with the two sections being at an angle of less than ninety degrees relative to each other.

4. The solderless connector of claim 3 wherein said first section of said arm extends obliquely upwardly from said floor means at an angle of about forty five degrees relative thereto and said second section extends obliquely towards said floor means at an angle of about seventy degrees relative thereto.

5. The solderless connector of claim 4 where stripping groove means is located at a free end of said second section and is adjacent said wire receiving means.

6. The solderless connector of claim 5 wherein said wire receiving means is located on a tab projecting outwardly from said floor means and said stripping groove means is positioned at an angle of twenty degrees relative thereto.

7. The solderless connector of claim 3 further including latch means for latching said stripping means after being moved along an insulated wire.

8. The solderless connector of claim 7 wherein said latch means include free end faces which bear against and restrain said first section from regressive movement.

9. A solderless connector of electrically terminating insulated wire, comprising;

a floor;

wire receiving means, attached to and extending from said floor, for receiving and supporting the insulated wire; and stripping means, pivotally mounted on and extending from said floor, for stripping insulation by engaging and being moved along the insulated wire positioned on said wire receiving means.

10. The solderless connector of claim 9 further including latch means for latching said stripping means after being moved along the insulated wire.

11. The solderless connector of claim 9 wherein said stripping means include an elongated arm folded intermediate the ends thereof to define first and second sections with the first section having one end attached to said floor and extending obliquely therefrom and with said second section attached to another end of said first section and extending obliquely towards said floor.

12. The solderless connector of claim 11 wherein said stripping means include groove means, located at the free end of said section, for removing insulation from the insulated wire and electrically engaging the conductor beneath the insulation.

13. The solderless connector of claim 12 wherein said wire receiving means is positioned at right angles to said floor and said second section is at an angle of about twenty degrees relative to said wire receiving means.

14. The solderless connector of claim 13 wherein said first and second sections diverge one from the other at an angle of less than ninety degrees.

* * * * *